United States Patent [19]

Pascucci et al.

[11] 4,352,428

[45] Oct. 5, 1982

[54] REED HOLDER

[75] Inventors: Vito S. Pascucci; Elmer J. Aiello, both of Kenosha, Wis.

[73] Assignee: G. Leblanc Corporation, Kenosha, Wis.

[21] Appl. No.: 225,258

[22] Filed: Jan. 15, 1981

[51] Int. Cl.[3] ..... B65D 51/26; B65D 41/00; A45C 11/00; B65D 85/20

[52] U.S. Cl. ..... 206/314; 206/805; 220/8

[58] Field of Search ..... 206/314, 805; 220/8

[56] References Cited

U.S. PATENT DOCUMENTS

| | | | |
|---|---|---|---|
| 2,197,565 | 4/1940 | Brand | 206/314 |
| 2,545,599 | 3/1951 | Bartlett | 24/259 |
| 2,687,157 | 8/1954 | Cowan | 150/0.5 |
| 2,910,173 | 10/1959 | Fenburr | 206/314 |
| 3,025,950 | 3/1962 | Nathan | 206/5.1 |
| 3,043,354 | 7/1962 | Fitzgerald | 150/0.5 |
| 3,344,913 | 10/1967 | Best | 206/314 |
| 3,393,793 | 7/1968 | Eresman | 206/314 |
| 3,494,499 | 2/1970 | Plog et al. | 220/8 |
| 4,089,412 | 5/1978 | Baugh | 206/805 |

*Primary Examiner*—William T. Dixson, Jr.

*Attorney, Agent, or Firm*—Trexler, Bushnell & Wolters, Ltd.

[57] ABSTRACT

A reed holder comprises a base member and a cover member. The base member includes at least one elongate, rigid member defining a planar, reed-receiving surface and at least one reed retaining member for removably securing a reed against the reed-receiving surface. The cover member defines an open-ended enclosure co-extensive with a predetermined portion of the planar reed-receiving surface for enclosing a tip portion of a read. Coacting assembly structures on the base member and on the cover member are provided for effecting non-removable assembly of the base member with the cover member.

9 Claims, 6 Drawing Figures

FIG. 1
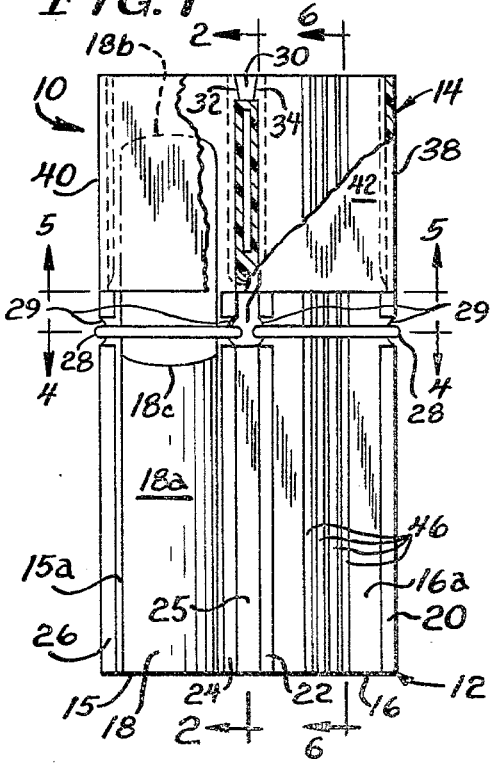
FIG. 2
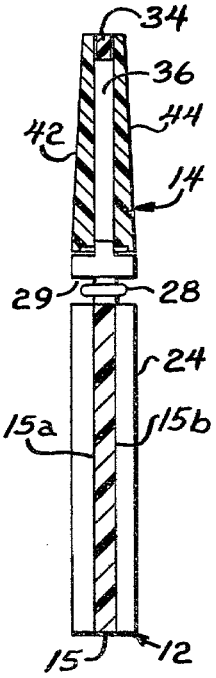
FIG. 3
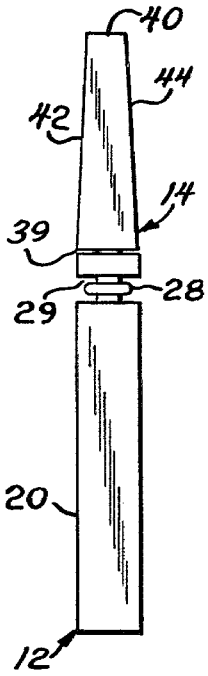
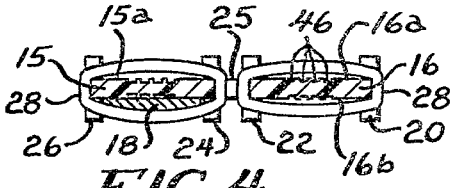
FIG. 4
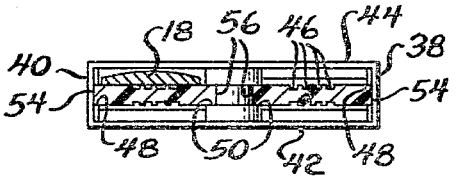
FIG. 5
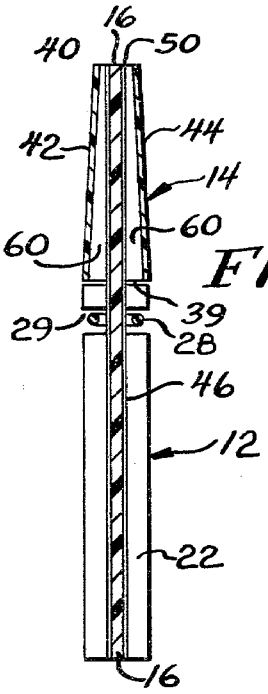
FIG. 6

REED HOLDER

BACKGROUND OF THE INVENTION

This invention is directed to a novel reed holder for holding one or more reeds of the type utilized for a clarinet or a saxophone.

Reeds of the type utilized for clarinets and saxophones generally comprise a thin, elongate piece of cane which is cut and shaped to a relatively close tolerance. Such reeds include a body portion having a curved top surface which tapers into a relatively thin, flat, tip portion. The entire reed, body and tip, is substantially flat on its under or back side. Modern machinery is capable of cutting and shaping such reeds to a tolerance of on the order of 0.01 millimeter or greater. The tip portions of reeds so formed are generally on the order of 0.08 to 0.09 millimeters thick.

Accordingly, these relatively thin, cane reed tips, like all woods, are susceptible to warping. This susceptibility is aggrevated by the stresses to which reeds are subjected in use. In this regard, a reed is alternatively soaked with saliva during playing and then dried during periods of non-use while in storage. Under such conditions, a reed is likely to warp and lose its playing quality. Moreover, the relatively thin tip portion must be protected against chipping or cracking when the reed is not in use, affixed to the instrument.

It is known that a reed will resist warping if it is dried exposed to air and lying substantially flat.

OBJECTS AND SUMMARY OF THE INVENTION

Accordingly, it is an object of the present invention to provide a novel and improved reed holder.

A more specific object is to provide a reed holder wherein a reed is held substantially flat and exposed to air to promote drying while avoiding warping.

BRIEF DESCRIPTION OF THE DRAWINGS

The foregoing as well as other objects, features and advantages of the invention will be best understood upon consideration of the following detailed description of the illustrated embodiment, together with reference to the accompanying drawings, wherein:

FIG. 1 is a plan view, partially broken away and partially in section, of a reed case in accordance with the invention;

FIG. 2 is a sectional view taken generally along the line 2—2 of FIG. 1;

FIG. 3 is a side elevation of the reed case of FIG. 1;

FIG. 4 is a sectional view taken generally along the line 4—4 of FIG. 1;

FIG. 5 is a sectional view taken generally along the line 5—5 of FIG. 1; and FIG. 6 is a sectional view taken generally along the line 6—6 of FIG. 1.

DETAILED DESCRIPTION OF THE ILLUSTRATED EMBODIMENT

Referring now to the drawings, there is seen a reed holder or case constructed in accordance with the invention and designated generally by the reference numeral 10. This reed holder or case 10 includes a base member, designated generally by the reference numeral 12, and a cover member, designated generally by the reference numeral 14. The base member 12 and cover member 14 are non-removably assembled to form the reed holder or case 10.

The base member 12 includes a pair of substantially rigid, elongate flat members 15, 16 which define flat surfaces for receiving the flat, back side of a reed, such as the reed 18, thereupon. In the illustrated embodiment, these reed-receiving surfaces are designated 15*a*, 15*b* and 16*a*, 16*b*, and are arranged side-by-side in back-to-back pairs. Accordingly, the elongate reed-receiving surfaces are all substantially co-extensive in length.

In order to position a reed 18 upon one of these reed-receiving surfaces, e.g., 15*a*, each said surface-defining member 15, 16 is provided with a pair of side wall portions 20, 22 and 24, 26. These side wall portions 20, 22 and 24, 26 are of a longitudinal extent substantially co-extensive with the base portion 18*a* of the reed, and a minor fractional portion of the tip 18*b* of the reed 18. A connecting member 25 joins the members 15, 16 between the side walls 22, 24, respectively, thereof. Moreover, the upper end faces of these side wall portions 20, 22 and 24, 26 form a stop surface for receiving the cover member 14 in assembled relation with respect to the base member 12. In this regard, the cover member 14 comprises an open-ended, sheath-like member whose side walls 38, 40, front wall 42 and back wall 44 are all of a length substantially co-extensive with the portions of the surface-defining members 15, 16 not enclosed by the side wall portions 20, 22 and 24, 26. In this way, the cover member 14 is arranged with respect to the base member 12 for enclosing a major portion of the reed tip 18*b*.

A reed 18 is additionally secured in substantially flat condition upon the reed-receiving surface 16 by means of an elastomeric band 28. One such elastomeric band 28 is provided in surrounding relation to each pair of surface-defining members 15, 16, for removably securing a reed to each of these surfaces 16.

Further in this regard, suitable cut-out portions 29 are provided in each of side walls 20, 22, 24 and 26 for locating the elastomeric bands 28 with respect to the length of the reed-receiving surface-defining members 15, 16. In the illustrated embodiment, these cut-out portions 29 are located along the length of these members 15, 16 so as to engage the reed 18 substantially immediately above a transition line 18*c* thereof between the base portion 18*a* and tip portion 18*b*.

To facilitate the non-removable assembly of the base member 12 with the cover member 14, cooperating locking means are provided respectively on the base member 12 and cover member 14. In this regard, the base member 12 includes an elongate, through opening or slot 30 located between the side-by-side members 15, 16 and extending from the outer end thereof to approximately the cut-out portions 29 of the inner side wall members 22 and 24, which receive the elastomeric bands 28. Additionally, the facing side or edge surfaces of the members 15, 16 which face across the slot 30 are provided with inwardly extending tab members 32, 34. In the illustrated embodiment, these tab members 32, 34 have inwardly facing ramp surfaces which generally converge along the lengths of the tabs inwardly toward the center of slot 30 and inwardly of the reed case 10.

Cooperatively, the cover member 14 is provided with a center wall portion 36 which is of substantially similar thickness to the width of the elongate slot 30, and therefore somewhat thicker than the spacing between the tabs 32, 34 at their facing edge surfaces. Consequently, the reed case 10 is readily assembled by slidably engaging the slot 30 and tabs 32, 34 with the center wall 36 until the tabs 32, 34 snappingly engage over the outer and face of center wall 36. The slot 30 renders the portions of the members 15, 16 to either side thereof sufficiently flexible to permit this operation. At the same time, it will be remembered that the bottom surface of the cover member 14 engages with the top-most surfaces of the side walls 20, 22 and 24, 26, thus additionally defining the assembled state of the reed case 10.

As best seen in FIGS. 4 and 5, a plurality of longitudinal grooves 46 extend the length of each of the reed-receiving surfaces 15*a*, 15*b*, 16*a*, 16*b*. Advantageously, these grooves promote the evaporation of moisture from a reed 18 when it is held to the reed case 10 by means of the elastomeric bands 26. Additionally, it will be noted that the cover member 14 is tapered from its lower or inner end 39 to its outer or upper end 40. It is believed that this taper also encourages the evaporation of moisture when the reed case 10 with one or more reeds 18 held therein is stored in an upright position, that is the position illustrated in FIGS. 1 through 3 and FIG. 6.

As best seen in FIG. 5, a groove or channel is provided interiorally of each of the side walls 38, 40 of the cover member 14. These longitudinally running grooves or channels are faced or opposed by similar grooves or channels 50, provided at either side of the center wall 36. Advantageously, these grooves or channels 48 and 50 cooperate to receive and position the respective inner and outer edges of the members 15, 16 of the base member 12, as indicated by reference numerals 54 and 56 in FIG. 4. The grooves or channels 48, 50 are substantially centered with respect to the tapered side walls 38, 40 of the cover member 14 so as to substantially center the members 15, 16 therein. Additionally, this centering leaves sufficient space to form receiving chambers 60 for the tip portions 18*b* of the reed 18 carried on the surfaces of the members 15, 16.

What has been shown and described herein is a novel and improved reed case. This novel reed case comprises an interlocking, two-piece assembly comprising a base member and a cover member. Preferably these two members or pieces are formed from a suitable plastics material, as by molding or other suitable manufacturing processes. Thus, the resiliency of the plastics material permits the interlocking engagement of the two pieces as described above to form the assembled reed case.

While the invention has been described hereinabove with reference to a preferred embodiment, the invention is not limited thereto. On the contrary, those skilled in the art may devise various changes, alternatives and modifications upon reading the foregoing descriptions. Accordingly, the invention includes such changes, alternatives and modifications insofar as they fall within the spirit and scope of the appended claims.

The invention is claimed as follows:

1. A reed holder comprising a common base member and a cover member, said common base member having a plurality of rigid, elongated portions extending therefrom in spaced apart parallel relation and with said common base member having planar surfaces each for receiving a reed with the flat surface thereof against said planar surfaces, and a plurality of elastomeric members respectively encircling said elongated portions, each for resiliently and releasably holding a reed against said planar surfaces, said cover member comprising an open-ended sleeve having top, bottom and side walls engageable over said elongated extending portions for covering a tip portion of each said reed, and means acting between said base member and said cover member for securing said reed holder in assembled condition.

2. A reed holder as set forth in claim 1 wherein the securing means comprises interlocking means on said cover and on said projecting portions.

3. A reed holder as set forth in claim 2 wherein the interlocking means comprises shoulders on said projecting portions, and wherein said cover has a partition lying between said projecting portions and having structure thereon cooperating with said shoulders.

4. A reed holder as set forth in claim 3 wherein it is the end of said partition that cooperates with said shoulders.

5. A reed holder as set forth in claim 3 wherein said shoulders are provided by teeth having tapers opposite said shoulders for facilitating assembly of said cover with said base.

6. A reed holder as set forth in claim 1 wherein said planar surfaces are provided with elongated ribs providing ventilation spaces for reeds.

7. A reed holder as set forth in claim 1 or claim 6 wherein the planar reed surfaces are arranged in back-to-back pairs.

8. A reed holder as set forth in claim 1 wherein said projections are provided with notches for positioning said elastomeric members.

9. A reed holder as set forth in claim 1 or in claim 8 wherein said base is provided with side walls and with partition wall means, said walls and wall means having interruptions therein for accommodating said elastomeric members.

* * * * *